US012103728B2

(12) United States Patent
Tanaka

(10) Patent No.: US 12,103,728 B2
(45) Date of Patent: Oct. 1, 2024

(54) SQUARE BOTTLE

(71) Applicant: YOSHINO KOGYOSHO CO., LTD., Tokyo (JP)

(72) Inventor: Toshimasa Tanaka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 26 days.

(21) Appl. No.: 18/086,130

(22) Filed: Dec. 21, 2022

(65) Prior Publication Data

US 2023/0202701 A1 Jun. 29, 2023

(30) Foreign Application Priority Data

Dec. 28, 2021 (JP) ..... 2021-213609

(51) Int. Cl.
*B65D 1/02* (2006.01)
*B65D 23/10* (2006.01)

(52) U.S. Cl.
CPC ..... *B65D 1/0223* (2013.01); *B65D 23/102* (2013.01)

(58) Field of Classification Search
CPC ..... B65D 1/0223; B65D 23/102
USPC ..... 215/384
See application file for complete search history.

(56) References Cited

U.S. PATENT DOCUMENTS 6,161,713 A * 12/2000 Krich ..... B65D 1/44 215/382
9,714,109 B2 * 7/2017 Kira ..... B65D 1/0223
2009/0321386 A1 * 12/2009 Lane ..... B65D 23/102 215/384
2010/0326951 A1 * 12/2010 Coley, Jr. ..... B65D 1/0223 215/382
2020/0002044 A1 * 1/2020 Sugizaki ..... B65D 1/0223

FOREIGN PATENT DOCUMENTS

CN 101378965 B * 11/2012 ..... B65D 1/0223
JP 2007-204061 A 8/2007
JP 2014108813 A * 6/2014 ..... B65D 1/0223
JP 2015089826 A * 5/2015 ..... B65D 1/0223
JP 2020183232 A * 11/2020

* cited by examiner

*Primary Examiner* — J. Gregory Pickett
*Assistant Examiner* — Niki M Eloshway
(74) *Attorney, Agent, or Firm* — Oliff PLC

(57) ABSTRACT

The present invention is a square bottle. In the square bottle, a body portion extending in a vertical direction is configured that a panel surface portion and a corner surface portion are disposed, a circumferential groove is formed at a center portion of the body portion in the vertical direction, a recessed portion for finger contact is disposed in a portion of the circumferential groove located on the panel surface portion, a horizontal stripe portion is provided at an upper end portion of an inner surface defining the circumferential groove, and a vertical stripe portion extending downward from the horizontal stripe portion is disposed.

6 Claims, 1 Drawing Sheet

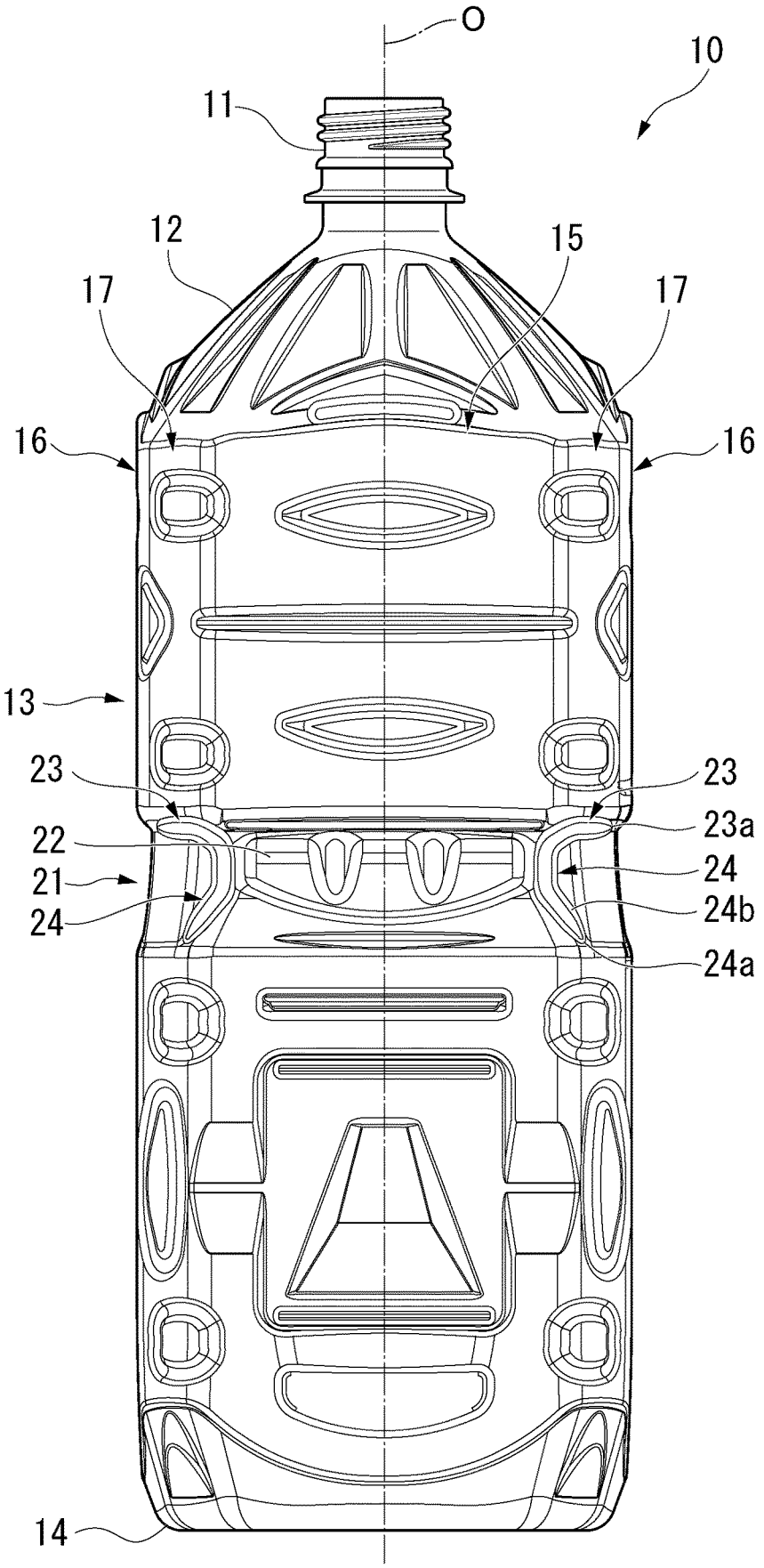
O
10
11
12
15
17
17
16
16
13
23
23
23a
22
24
21
24
24b
24a
14

SQUARE BOTTLE

CROSS-REFERENCE TO RELATED APPLICATION

Priority is claimed on Japanese Patent Application No. 2021-213609, filed Dec. 28, 2021, the content of which is incorporated herein by reference.

BACKGROUND OF THE INVENTION

Field of the Invention

The present invention relates to a square bottle.

Description of Related Art

From the related art, a square bottle as disclosed, for example, in Japanese Unexamined Patent Application, First Publication No. 2007-204061 is known. In the square bottle, a panel surface portion and a corner surface portion are alternately disposed in a circumferential direction along a central axis of a body portion extending in a vertical direction. A circumferential groove extending continuously over the entire length in the circumferential direction is formed at a center portion of the body portion in the vertical direction. A recessed portion for finger contact that is deeper than a depth of the circumferential groove is provided in a portion of the circumferential groove located on the panel surface portion.

However, in the square bottle of the related art, when a compressive load is applied in the vertical direction, for example, a portion of the circumferential groove provided with the recessed portion for finger contact is crushed in the vertical direction along with a reduction in weight, and among the plurality of panel surface portions, a panel surface portion that is not provided with the recessed portion for finger contact may be likely to undergo buckling deformation to bulge outward in a radial direction.

Therefore, an object of the present invention is to provide a square bottle that can suppress buckling deformation.

SUMMARY OF THE INVENTION

A first aspect of the present invention is a square bottle. In the square bottle, a body portion extending in a vertical direction is configured that a panel surface portion and a corner surface portion are alternately disposed in a circumferential direction along a central axis of the body portion. A circumferential groove extending continuously over an entire length in the circumferential direction is formed at a center portion of the body portion in the vertical direction. A recessed portion for finger contact, which is deeper than a depth of the circumferential groove, is disposed in a portion of the circumferential groove located on the panel surface portion. A horizontal stripe portion extending in the circumferential direction is provided at an upper end portion of an inner surface defining the circumferential groove, the horizontal stripe portion extending in a portion located between the recessed portion for finger contact and the corner surface portion which are adjacent to each other in the circumferential direction and in a portion located in the corner surface portion. A vertical stripe portion extending downward from the horizontal stripe portion is disposed in a portion located between the recessed portion for finger contact and the corner surface portion.

In this case, the horizontal stripe portion extending in the circumferential direction is provided at the upper end portion of the inner surface of the circumferential groove, in a portion located between the recessed portion for finger contact and the corner surface portion adjacent to each other in the circumferential direction, and in the portion located in the corner surface portion (hereinafter, these portions are collectively referred to as a "stepped portion"). As a result, when a compressive load is applied to the square bottle in the vertical direction, the horizontal stripe portion is compressed and deformed in the vertical direction, thereby making it possible to relieve the stress generated in the stepped portion, and making the stepped portion less likely to become a starting point of buckling deformation. The vertical stripe portion extending downward from the horizontal stripe portion is disposed in a portion located between the recessed portion for finger contact and the corner surface portion that are adjacent to each other in the circumferential direction. As a result, the stress generated in the stepped portion when a compressive load is applied to the square bottle in the vertical direction can be suppressed by being transferred to the panel surface portion via the horizontal stripe portion and the vertical stripe portion. As described above, buckling deformation can be suppressed.

According to a second aspect of the present invention, in the square bottle according to the first aspect, a distal end portion of the horizontal stripe portion on a side opposite to the vertical stripe portion is located on the corner surface portion adjacent to the vertical stripe portion in the circumferential direction.

In this case, the distal end portion of the horizontal stripe portion on the side opposite to the vertical stripe portion is located at the corner surface portion adjacent to the vertical stripe portion in the circumferential direction. As a result, it is possible to secure the rigidity against a compressive load in the vertical direction at the end portion on the side opposite to the vertical stripe portion among both end portions of the corner surface portion in the circumferential direction, and buckling strength of the square bottle can be secured.

According to a third aspect of the present invention, in the square bottle according to the first aspect or the second aspect, a portion located between the recessed portion for finger contact and the corner surface portion that are adjacent to each other in the circumferential direction extends inward in a radial direction from the corner surface portion toward the recessed portion for finger contact along the circumferential direction.

In this case, a portion located between the recessed portion for finger contact and the corner surface portion that are adjacent to each other in the circumferential direction extends inward in the radial direction from the corner surface portion toward the recessed portion for finger contact along the circumferential direction. As a result, it is possible to increase the rigidity of this portion against a compressive load in the vertical direction, and it is possible to reliably suppress buckling deformation.

According to a fourth aspect of the present invention, in the square bottle according to any one of the first to third aspects, a lower portion of the vertical stripe portion extends in a direction away from the recessed portion for finger contact in the circumferential direction as it goes downward.

In this case, the lower portion of the vertical stripe portion extends in a direction away from the recessed portion for finger contact in the circumferential direction as it goes downward. As a result, the stress generated in the stepped portion when a compressive load in the vertical direction is applied to the square bottle can be transferred over a wide range to both end portions of the first panel surface portion in the circumferential direction and can be reliably suppressed.

According to a fifth aspect of the present invention, in the square bottle according to the fourth aspect, the vertical stripe portion is located on the same panel surface portion over the entire length.

In this case, the vertical stripe portion is located on the same panel surface portion over the entire length. As a result, it is possible to secure the rigidity against the compressive load in the vertical direction at the end portion on the side of the vertical stripe portion among both end portions in the circumferential direction of the corner surface portion that is adjacent to the vertical stripe portion in the circumferential direction, and the buckling strength of the square bottle can be secured.

According to the present invention, buckling deformation can be suppressed.

BRIEF DESCRIPTION OF THE DRAWINGS

FIG. 1 is a side view of a square bottle shown as an embodiment.

DETAILED DESCRIPTION OF THE INVENTION

A square bottle according to an embodiment will be described below with reference to the drawings. As shown in FIG. 1, the square bottle 10 is configured that a mouth portion 11, a shoulder portion 12, a body portion 13, and a bottom portion 14 are disposed coaxially with a bottle axis O extending in a vertical direction, and connected in this order from the top to the bottom. Hereinafter, when viewed from the vertical direction, a direction intersecting the bottle axis O is referred to as a radial direction, and a direction rotating around the bottle axis O is referred to as a circumferential direction.

The square bottle 10 is formed by blow-molding a preform formed into a bottomed cylindrical shape by injection molding. The square bottle 10 is integrally formed of, for example, a synthetic resin material such as polyethylene terephthalate or polypropylene. A cap (not shown) is attached to the mouth portion 11. An internal volume of the square bottle 10 is sized to be filled with a liquid of, for example, 200 ml or more and 4000 ml or less. In the shown example, the internal volume of the square bottle 10 is sized to be filled with 2000 ml of liquid.

The body portion 13 extends in the vertical direction, is configured by alternately disposing the panel surface portions 15 and 16 and the corner surface portion 17 in the circumferential direction, and has a square shape in a cross-sectional view perpendicular to the bottle axis O. The panel surface portions 15 and 16 and the corner surface portion 17 are connected in the circumferential direction via a connecting portion formed in a curved surface shape that protrudes outward in the radial direction.

Each of the panel surface portions 15 and 16 extends substantially straight in the cross-sectional view. In addition, each of the panel surface portions 15 and 16 may have a curved shape that protrudes outward in the radial direction in the cross-sectional view. The corner surface portion 17 connects circumferential end portions of the panel surface portions 15 and 16 adjacent in the circumferential direction. The corner surface portion 17 has a width in the circumferential direction, and is formed in a stripe shape extending in the vertical direction. Each corner surface portion 17 extends substantially straight in the cross-sectional view. The width of each corner surface portion 17 is smaller than the size of each of the panel surface portions 15 and 16 in the circumferential direction. In addition, each corner surface portion 17 may have a curved shape that protrudes outward in the radial direction in the cross-sectional view.

The body portion 13 has a rectangular shape in the cross-sectional view, and is configured that a first panel surface portion 15 having a long side and a second panel surface portion 16 having a short side are connected in the circumferential direction via the corner surface portion 17. In addition, the body portion 13 may present a square shape by the cross-sectional view. In the shown example, a circumferential size of the second panel surface portion 16 is longer than half a circumferential size of the first panel surface portion 15. The shoulder portion 12 and the bottom portion 14 also exhibit a rectangular shape in the cross-sectional view, like the body portion 13.

The two first panel surface portions 15 face each other in the radial direction with the bottle axis O interposed therebetween. The two first panel surface portions 15 have the same shape. The two second panel surface portions 16 are opposite to each other in the radial direction with the bottle axis O interposed therebetween. The shapes of the two second panel surface portions 16 are the same as each other. The shapes of the first panel surface portion 15 and the second panel surface portion 16 are different from each other.

Here, the fact that the two first panel surface portions 15 have the same shape means not only that the outer edge shapes of the two first panel surface portions 15 are the same, but also that the shapes visually recognized from the whole including the recesses formed on the outer peripheral surface are the same as each other. This is also the same for the two second panel surface portions 16 as for the two first panel surface portions 15.

A circumferential groove 21 extending continuously over the entire length in the circumferential direction is formed in the center portion of the body portion 13 in the vertical direction. A recessed portion for finger contact 22, which is deeper than the depth of the circumferential groove 21, is provided in a portion of the circumferential groove 21 located on the first panel surface portion 15. The recessed portion for finger contact 22 is disposed in the center portion of the first panel surface portion 15. The recessed portion for finger contact 22 has a rectangular shape elongated in the circumferential direction in a front view seen from the outside in the radial direction. The recessed portion for finger contact 22 is provided in the portion of the circumferential groove 21 located on the first panel surface portion 15 over the entire length in the circumferential direction except for both end portions in the circumferential direction. A portion of the bottom surface of the circumferential groove 21 located at the corner surface portion 17 extends outward in the radial direction as it goes downward.

In the present embodiment, a horizontal stripe portion 23 extending in the circumferential direction is provided in the upper end portion of the inner surface that defines the circumferential groove 21, in a portion located between the recessed portion for finger contact 22 and the corner surface portion 17 that are adjacent to each other in the circumferential direction, and in a portion located in the corner surface portion 17.

A vertical stripe portion 24 extending downward from the horizontal stripe portion 23 is disposed in a portion located between the recessed portion for finger contact 22 and the corner surface portion 17 that are adjacent to each other in the circumferential direction. The portion located between the recessed portion for finger contact 22 and the corner surface portion 17 that are adjacent to each other in the circumferential direction extends inward in the radial direction from the corner surface portion 17 toward the recessed portion for finger contact 22 along the circumferential direction. The vertical stripe portion 24 is circumferentially separated from the corner surface portion 17 and is close to the recessed portion for finger contact 22 in the circumferential direction. The vertical stripe portion 24 and the horizontal stripe portion 23 are formed in the shape of hollow ridges. The vertical stripe portion 24 extends downward from the end portion of the recessed portion for finger contact 22 side among both end portions of the horizontal stripe portion 23 in the circumferential direction.

A distal end portion 23*a* of the horizontal stripe portion 23 on the side opposite to the vertical stripe portion 24 is located at the corner surface portion 17 adjacent to the vertical stripe portion 24 in the circumferential direction. That is, the distal end portion 23*a* of the horizontal stripe portion 23 does not reach the second panel surface portion 16. The distal end portion 23*a* of the horizontal stripe portion 23 is formed so that a width thereof becomes narrower and an amount of protrusion thereof decreases as it is separated from the vertical stripe portion 24 in the circumferential direction. The distal end portion 23*a* of the horizontal stripe portion 23 may reach the second panel surface portion 16 circumferentially beyond the corner surface portion 17 that is adjacent to the vertical stripe portion 24 in the circumferential direction.

A lower portion 24*b* of the vertical stripe portion 24 extends in a direction away from the recessed portion for finger contact 22 in the circumferential direction as it goes downward. The upper portion of the vertical stripe portion 24 extends straight in the vertical direction. A connecting portion between the vertical stripe portion 24 and the horizontal stripe portion 23 extends in a direction away from the recessed portion for finger contact 22 in the circumferential direction as it goes upward. The vertical stripe portions 24 are located on the same first panel surface 15 over the entire length. A lower end portion 24*a* of the vertical stripe portion 24 is formed so that the width becomes narrower and the amount of protrusion thereof decreases as it goes downward. Further, the lower end portion 24*a* of the vertical stripe portion 24 may extend beyond the first panel surface portion 15 in the circumferential direction and reach the corner surface portion 17.

The upper end portion of the recessed portion for finger contact 22 is located below the upper end portion of the horizontal stripe portion 23 and above the lower end portion of the horizontal stripe portion 23. The lower end portion of the recessed portion for finger contact 22 is located above the lower end portion 24*a* of the vertical stripe portion 24 and below the upper portion of the vertical stripe portion 24. The positions in the vertical direction of each of the upper end portion and the lower end portion of the recessed portion for finger contact 22 with respect to the horizontal stripe portion 23 and the vertical stripe portion 24 are not limited to the shown example, and may be changed as appropriate.

As described above, according to the square bottle 10 according to the present embodiment, the horizontal stripe portion 23 extending in the circumferential direction is provided at the upper end portion of the inner surface of the circumferential groove 21, in a portion located between the recessed portion for finger contact 22 and the corner surface portion 17 adjacent to each other in the circumferential direction, and in the portion located in the corner surface portion 17 (hereinafter, these portions are collectively referred to as a "stepped portion"). As a result, when a compressive load is applied to the square bottle 10 in the vertical direction, the horizontal stripe portion 23 is compressed and deformed in the vertical direction, thereby making it possible to relieve the stress generated in the stepped portion, and making the stepped portion less likely to become a starting point of buckling deformation. The vertical stripe portion 24 extending downward from the horizontal stripe portion 23 is disposed in a portion located between the recessed portion for finger contact 22 and the corner surface portion 17 that are adjacent to each other in the circumferential direction. As a result, the stress generated in the stepped portion when a compressive load is applied to the square bottle 10 in the vertical direction can be suppressed by being transferred to the first panel surface portion 15 via the horizontal stripe portion 23 and the vertical stripe portion 24. As described above, buckling deformation can be suppressed.

The distal end portion 23*a* of the horizontal stripe portion 23 on the side opposite to the vertical stripe portion 24 is located at the corner surface portion 17 adjacent to the vertical stripe portion 24 in the circumferential direction. As a result, it is possible to secure the rigidity against the compressive load in the vertical direction at the end portion on the side opposite to the vertical stripe portion 24 among both end portions of the corner surface portion 17 in the circumferential direction, and buckling strength of the square bottle 10 can be secured.

A portion located between the recessed portion for finger contact 22 and the corner surface portion 17 that are adjacent to each other in the circumferential direction extends inward in the radial direction from the corner surface portion 17 toward the recessed portion for finger contact 22 along the circumferential direction. As a result, it is possible to increase the rigidity of this portion against a compressive load in the vertical direction, and it is possible to reliably suppress buckling deformation.

A lower portion 24*b* of the vertical stripe portion 24 extends in a direction away from the recessed portion for finger contact 22 in the circumferential direction as it goes downward. As a result, the stress generated in the stepped portion when a compressive load in the vertical direction is applied to the square bottle 10 can be transferred over a wide range to both end portions of the first panel surface portion 15 in the circumferential direction and can be reliably suppressed.

The vertical stripe portion 24 is located on the same first panel surface portion 15 over the entire length. As a result, it is possible to secure the rigidity against the compressive load in the vertical direction at the end portion on the side of the vertical stripe portion 24 among both the end portions in the circumferential direction of the corner surface portion 17 that is adjacent to the vertical stripe portion 24 in the circumferential direction, and the buckling strength of the square bottle 10 can be secured.

The technical scope of the present invention is not limited to the above-described embodiments, and various modifications can be made without departing from the scope of the present invention.

For example, the vertical stripe portion 24 may be separated from the recessed portion for finger contact 22 in the circumferential direction, and may be close to the corner surface portion 17 in the circumferential direction. The lower portion 24*b* of the vertical stripe portion 24 may extend straight in the vertical direction.

In addition, it is possible to appropriately replace the constituent elements in the above embodiments with known constituent elements without departing from the scope of the present invention, and the above embodiments and the above modifications may be combined as appropriate.

What is claimed is:

1. A square bottle, wherein a body portion extending in a vertical direction is configured that a panel surface portion and a corner surface portion are alternately disposed in a circumferential direction along a central axis of the body portion, a circumferential groove extending continuously over an entire length in the circumferential direction is formed at a center portion of the body portion in the vertical direction, a recessed portion for finger contact, which is deeper than a depth of the circumferential groove, is disposed in a portion of the circumferential groove located on the panel surface portion, a horizontal stripe portion extending in the circumferential direction is provided at an upper end portion of an inner surface defining the circumferential groove, the horizontal stripe portion extending in a portion located between the recessed portion for finger contact and the corner surface portion which are adjacent to each other in the circumferential direction and in a portion located in the corner surface portion, the horizontal stripe portion having a first end portion near the recessed portion for finger contact and a second end portion away from the recessed portion for finger contact, and a vertical stripe portion extending downward from the first end portion of the horizontal stripe portion is disposed in a portion located between the recessed portion for finger contact and the corner surface portion.

2. The square bottle according to claim 1, wherein the second end portion of the horizontal stripe portion is located on the corner surface portion adjacent to the vertical stripe portion in the circumferential direction.

3. The square bottle according to claim 1, wherein a portion located between the recessed portion for finger contact and the corner surface portion that are adjacent to each other in the circumferential direction extends inward in a radial direction from the corner surface portion toward the recessed portion for finger contact along the circumferential direction.

4. The square bottle according to claim 1, wherein a lower portion of the vertical stripe portion extends in a direction away from the recessed portion for finger contact in the circumferential direction as it goes downward.

5. The square bottle according to claim 4, wherein the vertical stripe portion is located on the same panel surface portion over an entire length.

6. The square bottle according to claim 1, wherein the vertical stripe portion and the horizontal stripe portion are formed in a shape of a hollow ridge.

* * * * *